US007079096B2

(12) United States Patent
Washio et al.

(10) Patent No.: US 7,079,096 B2
(45) Date of Patent: Jul. 18, 2006

(54) IMAGE DISPLAY DEVICE AND DISPLAY DRIVING METHOD

(75) Inventors: Hajime Washio, Sakurai (JP); Yasuyoshi Kaise, Tenri (JP); Kazuhiro Maeda, Nara (JP); Yasushi Kubota, Sakurai (JP)

(73) Assignee: Sharp Kabushiki Kaisha, Osaka (JP)

( * ) Notice: Subject to any disclaimer, the term of this patent is extended or adjusted under 35 U.S.C. 154(b) by 404 days.

(21) Appl. No.: 10/253,570

(22) Filed: Sep. 24, 2002

(65) Prior Publication Data

US 2003/0058207 A1 Mar. 27, 2003

(30) Foreign Application Priority Data

Sep. 25, 2001 (JP) ..... 2001-292226
Dec. 21, 2001 (JP) ..... 2001-390589

(51) Int. Cl.
*G09G 3/36* (2006.01)

(52) U.S. Cl. ..... 345/87; 345/100

(58) Field of Classification Search ..... 345/87, 345/98–100
See application file for complete search history.

(56) References Cited

U.S. PATENT DOCUMENTS 4,906,984 A * 3/1990 Takeda et al. ..... 345/90
5,686,936 A * 11/1997 Maekawa et al. ..... 345/100
5,977,940 A * 11/1999 Akiyama et al. ..... 345/94
6,084,562 A * 7/2000 Onda ..... 345/94
6,124,839 A * 9/2000 Usui ..... 345/94
6,278,426 B1 8/2001 Akiyama
6,392,619 B1 * 5/2002 Nitta et al. ..... 345/87
6,489,952 B1 * 12/2002 Tanaka et al. ..... 345/205
6,618,033 B1 * 9/2003 Takafuji ..... 345/96
2001/0017609 A1 * 8/2001 Okumura et al. ..... 345/98
2001/0020928 A1 * 9/2001 Yanagisawa et al. ..... 345/98
2002/0036636 A1 * 3/2002 Yanagi et al. ..... 345/211

FOREIGN PATENT DOCUMENTS

JP 06-149180 5/1994
JP 06-337657 12/1994
JP 11-085107 3/1999
JP 2000-221932 8/2000
JP 2001-255857 9/2001
JP 2002-297110 10/2002
JP 2002-311926 10/2002

* cited by examiner

*Primary Examiner*—Xiao Wu
*Assistant Examiner*—M. Fatahiyar
(74) *Attorney, Agent, or Firm*—David G. Conlin; William J. Daley, Jr.; Edwards, Angell, Palmer & Dodge LLP

(57) ABSTRACT

Before a potential of counter electrode is changed, a potential holding circuit fixedly holds potentials of data signal lines S during a non-selective period of scanning signal lines G. This prevents the potentials of the data signal lines S from being an undesirably large potential, which is caused by coupling capacitors between the counter electrode and each data signal line S, whereby it is possible to supply to the pixel capacitor an electric charge corresponding to a gradation to be displayed, by using the relatively low potentials of the data signal lines S. This lowers a power supply voltage of a data signal driving circuit SD, thus reducing the electric power consumption. In short, with this arrangement, a liquid crystal display device can perform an opposed AC drive for line-inversion drive, frame-inversion drive and the like, by low power supply voltage of the data signal line driving circuit SD, thereby reducing the electric power consumption.

20 Claims, 11 Drawing Sheets

IMAGE DISPLAY DEVICE AND DISPLAY DRIVING METHOD

FIELD OF THE INVENTION

The present invention relates to (a) an active-matrix-type image display device, preferably realized as a liquid crystal display device and the like, that includes an electro-optical element and a corresponding pair of an active element and a pixel capacitor, which are provided in each area sectored by a plurality of scanning lines and a plurality of data signal lines intersecting with each other and (b) a driving method thereof. The present invention particularly relates to an image display device and a display driving method thereof arranged so that a potential of a counter electrode, which forms the pixel capacitor, is changed so as to perform opposed AC drive.

BACKGROUND OF THE INVENTION

FIG. 7 shows a typical active-matrix-type image display device in a prior art, and gives illustration as a block diagram showing an electric structure of a liquid crystal display device 1. The liquid crystal display device 1 schematically includes: a display section 2; a scanning signal line driving circuit gd; a data signal line driving circuit sd; and a control signal generating circuit ct1. In the display section 2, as described above, there is provided a pixel PIX in each area, sectored in matrix by a plurality of scanning signal lines g1, g2, . . . , gm (hereinafter shown by a reference sign g when they are collectively referred) and data signal lines s1, s2, . . . , sn (hereinafter shown by a reference sign s when they are collectively referred).

As shown in FIG. 8, each pixel PIX includes: an active element SW and a pixel capacitor Cp. When the scanning signal lines g are selectively scanned, the active elements SW lead image signals DAT of the data signal lines s to the pixel capacitor Cp, so as to hold the image signals DAT also in the non-scanning period, thereby maintaining the display state. The pixel capacitor Cp is constituted of a liquid crystal capacitor CL and an auxiliary capacitor Cs.

The data signal driving circuit sd is constituted of a shift resistor 3 and a sampling circuit 4. In the data signal driving circuit sd, the shift resistor 3 performs sampling with respect to the image signals DAT that have been inputted to an analog switch of the sampling circuit 4 in synchronism with timing signals such as (a) a clock signal CKS from the control signal generating circuit ct1, (b) an inversion signal CKSB corresponding to CKS, and (c) a data scanning start signal SPS, so as to write the thus sampled image signal DAT in the data signal lines s as required.

The scanning signal line driving circuit gd is constituted of a shift resistor 5, and selectively scans the scanning signal lines g sequentially in synchronism with the timing signals such as (a) a clock signal CKG from the control signal generating circuit ct1 and (b) a scanning start signal SPG, so as to control ON/OFF of the active elements SW disposed in the pixels PIX. When the active elements SW are ON, the image signals DAT in the data signal lines s are written in the pixels PIX so as to be held by the pixel capacitor Cp disposed in each pixel PIX as described above. The operation described above is repeatedly performed, so that it is possible to display images on the display section 2.

FIG. 9 is a waveform chart showing an example of a drive waveform of the foregoing writing operation. In this example, a horizontal-line-inversion-type driving method is employed. The image signal DAT is outputted from the control signal generating circuit ct1 and is inputted to the data signal line driving circuit sd, in synchronism with the clock signals CKS, CKSB, and the data scanning start signal SPS. In this example, image signals of positive polarity are written in the pixels of odd-numbered scanning signal lines (g1, g3, . . . ), and image signals of negative polarity are written in the pixels of even-numbered scanning lines (g2, g4, . . . ). Moreover, the liquid crystal display device 1 is driven by the opposed AC drive. Thus, each image signal DAT includes an offset potential that is equivalent to a potential of Vcom of the counter electrode.

The data signal line driving circuit sd is described below in detail. FIG. 10 is a block diagram illustrating an example of a structure of the data signal line driving circuit sd. In FIG. 10, the reference number FF indicates a flip-flop. The FFs are serially connected in multi-stages so as to form the shift register 3. In the sampling circuit 4, nonconjunctions of respective outputs between the FFs are worked out by means of NAND gates a1 to an, so as to generate sampling signals smp1 to smpn, so that invertors inv1 to invn and analog switches asw1 to aswn are operated in accordance with the thus obtained sampling signals smp1 to smpn. In this way, the sampling circuit 4 supplies the image signals DAT of both polarities respectively to the data signals s1 to sn.

FIG. 11 is a timing chart for further detailed explanation on operation of the liquid crystal display device 1 thus arranged. As described above, the FFs and the NAND gates a1 to an generate the sampling signals smp1 to smpn, which respectively correspond to the data signal lines s1, s2, . . . sn, in response to the clock signals CKS, SKSB and the data scanning start signal SPS. In accordance with the sampling signals smp1 to smpn, the analog switches asw1 to aswn for both the polarities supply sequentially to the data signals s1, s2, . . . sn, the image signals DAT for realizing the opposed AC drive. In FIG. 11, the potential Vcom of the counter electrode for realizing the opposed AC drive is indicated by a broken line.

Here, the operation of the liquid crystal display device 1 is further described, drawing an attention to an i-th data signal line si. To begin with, when the sampling signal smpi becomes high level at time t1, the analog switch aswi is turned ON, so as to start charging the data signal line si with a potential Vdatap of the image signal DAT of positive polarity. In an almost same timing, the scanning signal lines gj are turned ON, so as to start charging a pixel capacitor Cp of a pixel of row j and column i with the potential Vdatap of the image signal DAT. When the scanning signal line gj is turned OFF, the charging of the pixel capacitor Cp is terminated (ended). When the sampling signal smpi becomes low level, the analog switch aswi is turned OFF, so as to float the data signal line si (so as to put the data signal line si in a floating condition), thereby terminating the charging of the data signal line si.

When the data scanning start signal SPS is inputted at time t2, so as to start a next horizontal scanning period, the potential Vcom of the counter electrode is changed from the low level to the high level, due to the opposed AC drive. Here, the data signal line si is electrically floated. For this reason, the potential of the data signal line si is also changed following the change in the potential Vcom of the counter electrode, thereby being increased to a sum of the potential Vdatap of the image signal DAT of positive polarity and the potential Vcom of the counter electrode, because the capacitance of the data signal line si and that of the counter electrode are coupled (that is, due to coupling capacitance between the data signal line si and the counter electrode).

Similarly, at time t3, the potential Vdatan of the image signal DAT of negative polarity is supplied, so that the next horizontal scanning period is started at time t4, thereby changing the potential Vcom of the counter electrode from high level to low level. In accordance with the change in the potential Vcom, the potential of the data signal line si is decreased to a sum of the potential Vdatan, and the potential Vcom. Therefore, caused in the data signal line si are potential changes Vdatap+Vcom, and Vdatan−Vcom, based on GND of a power supply of the data signal line driving circuit sd.

Here, for example, if Vdatap=7V, Vdatan=2V, and Vcom has an amplitude of 5V, the potential of the data signal line si is 12V at time t2, and −3V at time t4. Thus, in this case, it is necessary to set the data signal line driving circuit sd to have a power supply potential VDD of 12V or more, and a power supply potential VSS of −3V or less. If the power supply potential VDD is lower, or the power supply potential VSS is higher, the data signal line si has a potential higher than that of the sampling signal smpi, which drives a gate of the analog switch aswi, the gate being connected to the data signal line si. This may influence the operation of the data signal line driving circuit sd.

On the other hand, there has been a strong demand for a liquid crystal display device of low electric power consumption recent years. Here, electric power consumption P is calculated by using the following equation (1):

$$P=cfV^2 \quad (1)$$

where an internal capacitance is c, a driving frequency is f, and the power supply voltage is V.

It has been attempted to keep the electric power consumption P low by lowering the driving frequency f. However, the electric power consumption P is in proportion to a square of the power supply voltage V. Therefore, lowering the power supply voltage V contributes more to lowering the electric power consumption P. However, as described above, the use of the AC drive may require a sufficiently high power supply voltage for the data signal line driving circuit sd, in order to be able to deal with a case where a potential change in the data signal lines due to the change in the potential Vcom of the counter electrode. It is a problem that this results in high electric power consumption.

SUMMARY OF THE INVENTION

The present invention has an object of providing an image display device and a display driving method, which are capable of reducing electric power consumption by lowering a power supply voltage of a data signal line driving circuit.

In order to attain the object, an image display device of the present invention, including, in each area sectored by a plurality of scanning lines and a plurality of data signal lines intersecting with each other, a pixel circuit including an electro-optic element and a corresponding pair of an active element and a pixel electrode, the electro-optic element being driven to create a display in accordance with an electric charge that has been taken in a pixel capacitor by the active element, the pixel capacitor being formed between the pixel electrode and an counter electrode, the image display device is provided with a potential holding section for fixedly holding potentials of the data signal lines before a potential of the counter electrode is changed.

This arrangement is adopted in the image display device in which the active element is provided at each intersection between the plurality of the scanning signal lines and the plurality of the data signal lines intersecting with each other, so that the active element supplies the image signal of the data signal lines into the pixel capacitor (the image signal is taken into the pixel capacitor by the active element) by selectively scanning the scanning signal lines, so as to drive the electro-optic element by the thus taken-into electric charge so as to create a display, so as to maintain the display in a non-selective period. With the above arrangement adopted in the image display device, when performing an opposed AC drive, the potentials of the data signal lines in the non-selective period, are fixedly held by the potential holding section, and then the potential of the counter electrode is changed while the potentials of the data signal lines are thus fixedly held. Here, the potential holding section becomes high impedance at a time at which selective scanning of the scanning signal lines is about to be started in a next frame, thereby floating the data signal lines at the time.

Therefore, coupling capacitances between the data signal lines and the counter electrode will not cause the potentials of the data signal lines to be undesirably large potentials, when the potential of the counter electrode is changed for line-inverting drive or frame-inverting drive. With this arrangement, it is possible to supply to the pixel capacitor an electric charge corresponding to a gradation to be displayed, by using relatively low potentials of the data signal lines. This lowers a power supply voltage of a data signal driving circuit, thus reducing the electric power consumption.

Furthermore, an image display device of the present invention, is provided with, in each area sectored by a plurality of scanning lines and a plurality of data signal lines intersecting with each other, a pixel circuit including an electro-optic element and a corresponding pair of an active element and a pixel electrode, the electro-optic element being driven to create a display in accordance with an electric charge that has been taken in a pixel capacitor by the active element, the pixel capacitor being formed between the pixel electrode and an counter electrode, the image display device is provided with a potential holding section for fixedly holding, to be equivalent with a potential of the counter electrode, potentials of the data signal lines when a potential of the counter electrode is changed, and for removing an electric charge between the counter electrode and each data signal line.

This arrangement is adopted in the image display device in which the active element is provided at each intersection between the plurality of the scanning signal lines and the plurality of the data signal lines intersecting with each other, so that the active element supplies the image signal of the data signal lines into the pixel capacitor by selectively scanning the scanning signal lines, so as to drive the electro-optic element by the thus taken-into electric charge so as to create a display, so as to maintain the display in a non-selective period. With the above arrangement adopted in the image display device, when performing an opposed AC drive, the potentials of the data signal lines in the non-selective period, is temporally fixedly held by the potential holding section so as to be equivalent to the potential of the counter electrode, and the electric charge between the counter electrode and each data signal line is removed. Here, the potential holding section becomes high impedance at a time at which selective scanning of the scanning signal lines is about to be started in a next frame, thereby floating the data signal lines at the time.

Here, it may be arranged so that the potential of the counter electrode is thereafter changed following a change in the potential of the counter electrode, when the potential of the counter electrode is changed, or that the potential holding section becomes high impedance to be floated.

Therefore, coupling capacitances between the data signal lines and the counter electrode will not cause the potentials of the data signal lines to be undesirably large potentials, when the potential of the counter electrode is changed for line-inverting drive or frame-inverting drive. With this arrangement, it is possible to supply to the pixel capacitor an electric charge corresponding to a gradation to be displayed, by using relatively low potentials of the data signal lines. This lowers a power supply voltage of a data signal driving circuit, thus reducing the electric power consumption.

For a fuller understanding of the nature and advantages of the invention, reference should be made to the ensuing detailed description taken in conjunction with the accompanying drawings.

DESCRIPTION OF THE EMBODIMENTS

One embodiment of the present invention is described as follows based on drawings.

Figure 1:
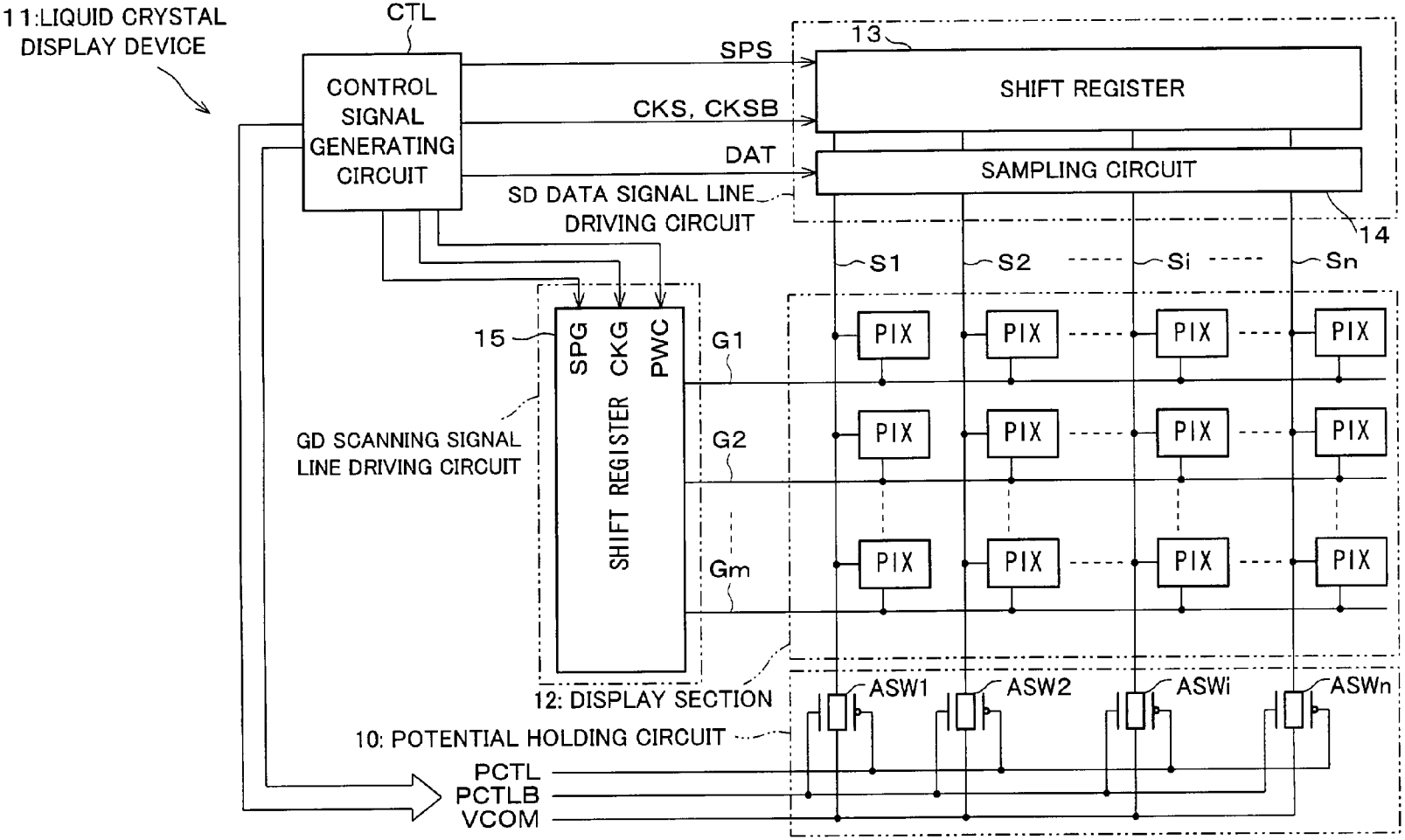
FIG. 1 is a block diagram showing an electric structure of a liquid crystal display device, which is an image display device of one embodiment of the present invention.

FIG. 1 is a block diagram showing an electric structure of a liquid crystal display device 11, which is an image display device of one embodiment of the present invention. The liquid crystal display device 11 is an active-matrix-type liquid crystal display device, and schematically includes: a display section 12; a scanning signal line driving circuit GD; a data signal line driving circuit SD; a potential holding circuit 10; and a control signal generating circuit CTL. The data signal line driving circuit SD is composed of a shift resistor 13 and a sampling circuit 14, and the scanning signal line driving circuit GD is composed of a shift resistor 15. The data signal line driving circuit SD and the scanning signal line driving circuit GD are arranged same as the data signal line driving circuit sd and the scanning signal line driving circuit gd in the aforementioned liquid crystal display device 1, so that description thereof is omitted.

Further, in the display section 12, as described above, there is provided a pixel PIX at each area sectored by scanning signal lines G1, G2, . . . , Gm (hereinafter shown by reference sign G when they are collectively referred) and data signal lines S1, S2, . . . , Sn (hereinafter shown by reference sign S when they are collectively referred) in a matrix manner. Further, the liquid crystal display device 11 of the present invention is so arranged that the data signal lines S are connected to the data signal line driving circuit SD, as in the liquid crystal display device 1, but the present invention is arranged so that the potential holding circuit 10 is further provided in relation to the data signal lines S. According to an example shown in FIG. 1, the data signal line driving circuit SD is provided on one end of the data signal lines S, and the potential holding circuit 10 is provided on the other end. Also in a case where these circuits are provided on the same side of the display section 12, it is possible to obtain the same effect.

Figure 8:
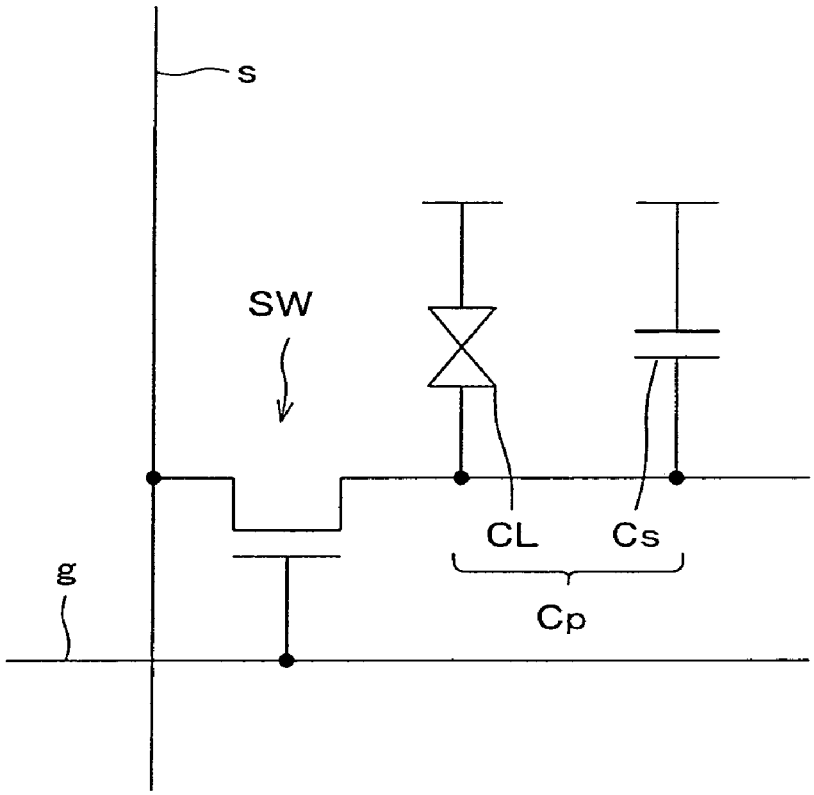
FIG. 8 PRIOR ART
FIG. 8 is an equivalent circuit diagram of respective pixels of the conventional/prior art liquid crystal display device.
Figure 9:
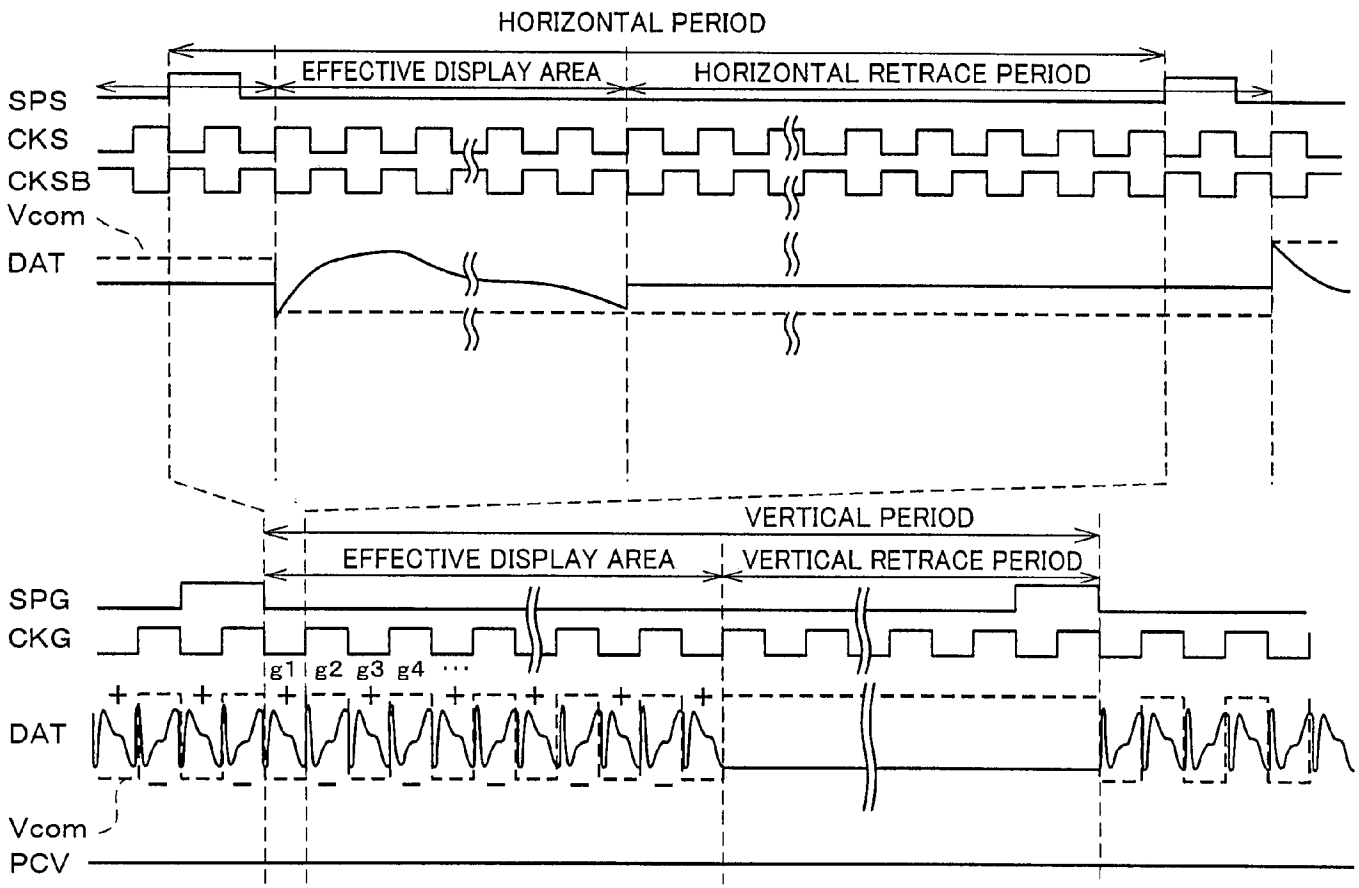
FIG. 9 PRIOR ART
FIG. 9 is a waveform chart showing an example of a drive waveform of the conventional/prior art liquid crystal display device shown in FIG. 7.

Also the control signal generating circuit CTL outputs the signals CKS, CKSB, SPS, DAT, CKG, and SPG, as the aforementioned control signal generating circuit ct1 does, and further outputs control signals PCTL and PCTLB (which is an inversion signal of PCTL) and a holding potential VCOM, described later, for the potential holding circuit 10. Each of the pixels PIX is arranged similarly to the pixel PIX shown in FIG. 8.

Figure 10:
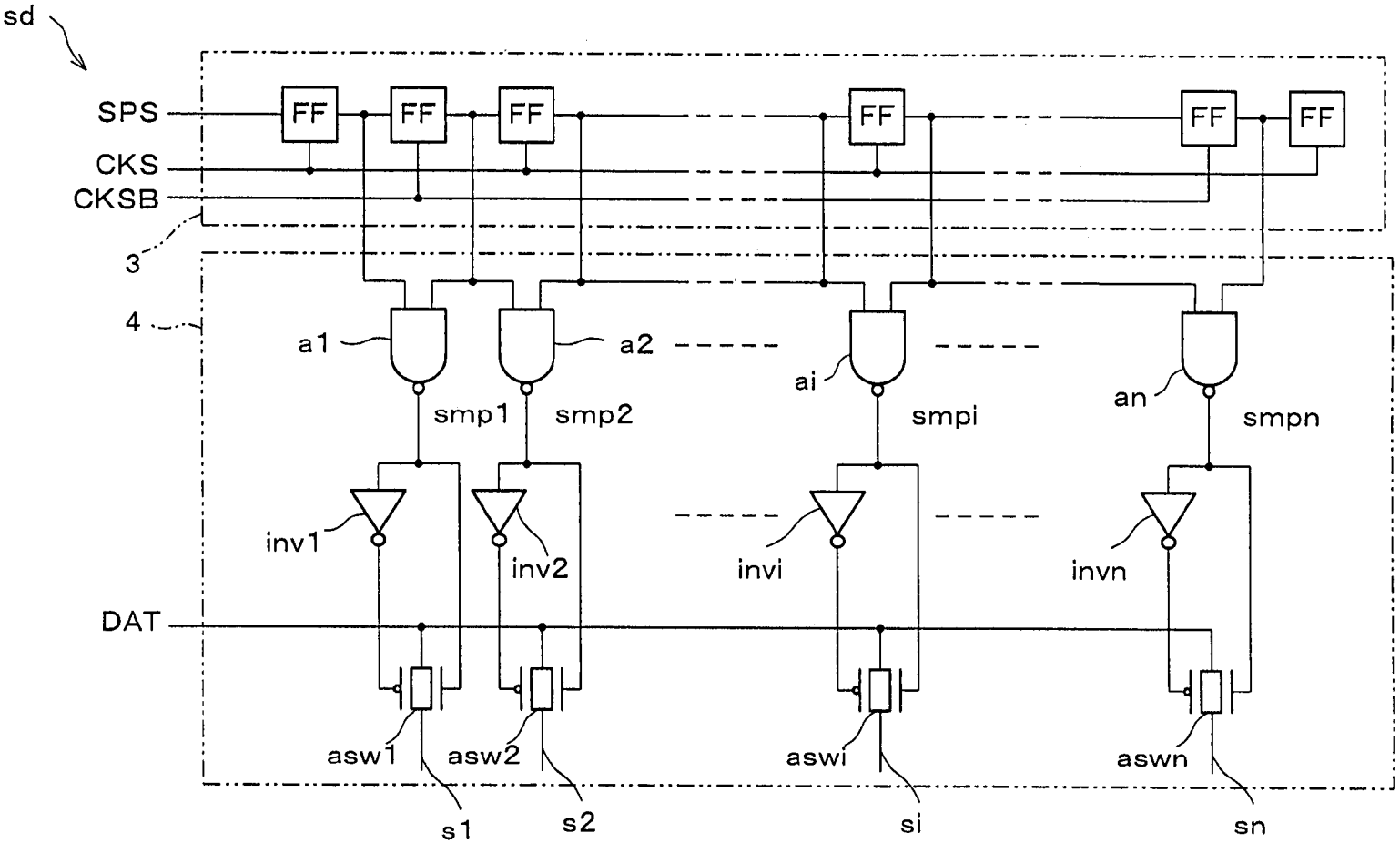
FIG. 10 PRIOR ART
FIG. 10 is a block diagram illustrating a structural example of a conventional/prior art data signal line driving circuit.
Figure 11:
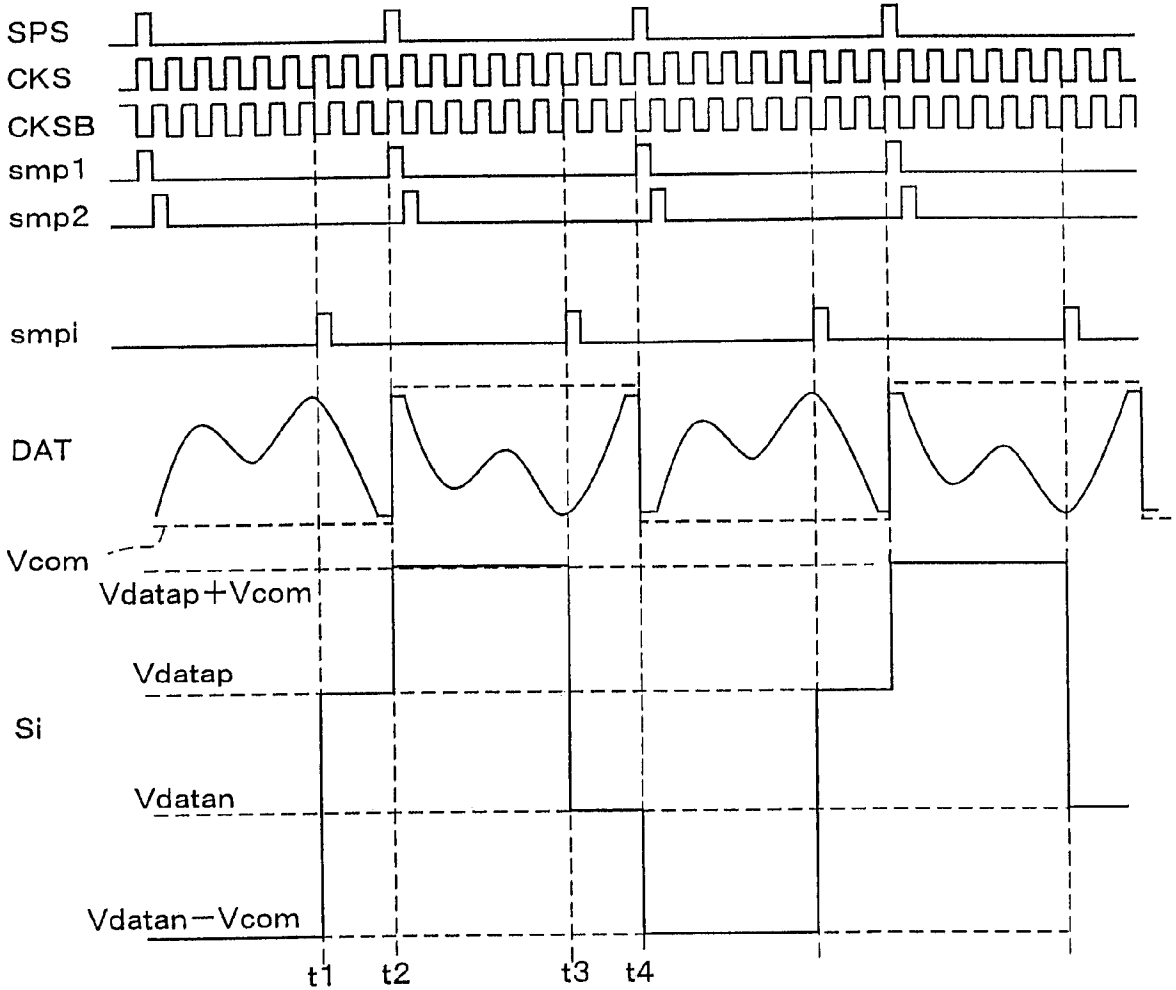
FIG. 11 PRIOR ART
FIG. 11 is a timing chart for explaining in detail an operation shown in FIG. 9.

The potential holding circuit 10 is composed of analog switches ASW1 to ASWn, each of which is constituted of a pair of a P-type switching element and an N-type switching element, the analog switches ASW1 to ASWn being provided on the respective data signal lines S, so as to be able to output a holding potential VCOM having both positive and negative polarities, similarly to the analog switches asw1 to aswn of the sampling circuit 14 (equivalent to the sampling circuit 4 shown in FIG. 10) of the data signal line driving circuit SD. The control signals PCTL and PCTLB are inputted commonly to the analog switches ASW1 to ASWn, so that the holding potential VCOM is outputted to the respective data signal lines S.

Figure 2:
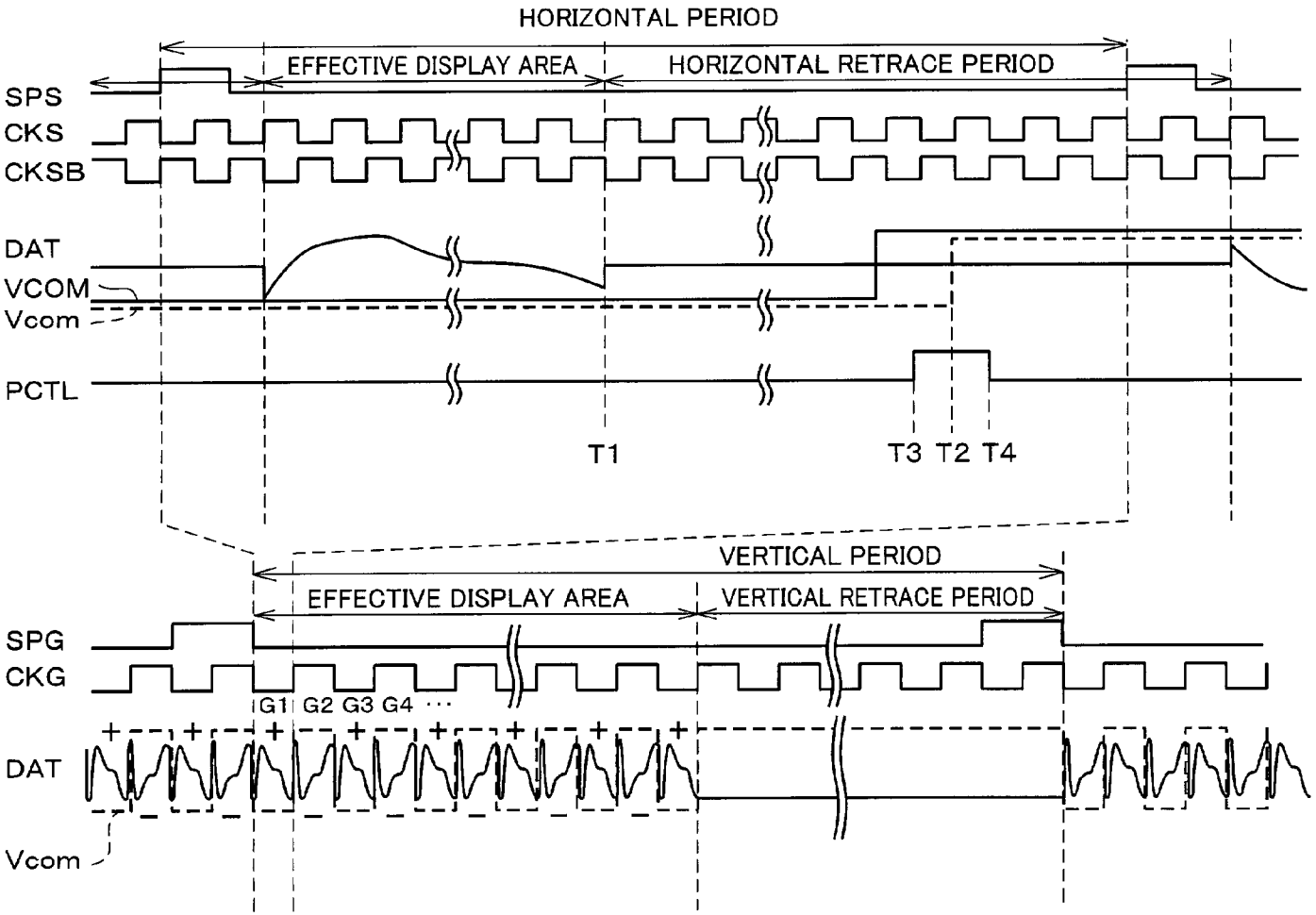
FIG. 2 is a waveform chart showing an example of a drive waveform of the liquid crystal display device.

FIG. 2 is a waveform chart showing an example of a drive waveform of the liquid crystal display device 11 arranged as above. In this example, a horizontal-line-inversion-system driving method is employed. To begin with, inputted from the control signal generating circuit CTL to the data signal line driving circuit SD is an image signal DAT in synchronism with the clock signals CKS and the CKSB, and the data scanning start signal SPS. In this example, the scanning signal lines G1, G3, . . . , which are oddly numbered, receive an image signal of positive polarity, while the scanning signal lines G2, G4, . . . , which are evenly numbered, receive an image signal of negative polarity. Moreover, because the liquid crystal display device 11 is oppositely AC driven, a potential Vcom of a counter electrode has a polarity opposite to that of the image signal DAT. With this arrangement, the data signal line driving circuit SD drives the data signal lines S, similarly to the prior arts.

Moreover, similarly to the prior art, the scanning signal line driving circuit GD sequentially selectively scans each scanning single line G in synchronism with a timing signal such as the clock signal CKG from the control signal generating circuit CTL and the scanning start signal SPG, and controls ON/OFF of active elements SW in the pixels PIX, so that the data signal line driving circuit SD also writes in each pixel PIX each image signal DAT supplied to the data signal lines S, so as to cause the image signal DAT in a pixel capacitor Cp in each pixel PIX by.

However, in this example of driving, the control signal generating circuit CTL changes, in one horizontal period, the control signals PCTL and PCTLB within a horizontal retrace period after the image signal DAT in written in all the pixel capacitors Cp of the pixel PIXs in an effective display area of the display section 12, and before changing the potential Vcom of the counter electrode by raising the data scanning start signal SPS so as to start a next horizontal period. Thereby, the control signal generating circuit causes the potential holding circuit 10 to fixedly hold potentials of the data signal lines S to the holding potential VCOM.

In short, when driving of the last data signal line Sn is ended at T1, so that a scanning signal line Gi (1≦i≦m), which has been selectively scanned, is turned to non-selected state, the active elements SW of all the pixels PIX are turned off to be floated. Here, each of the data signal lines S still keeps therein the image signal DAT of the pixel PIX. In time T3, which is before time T2 in which the potential Vcom of the counter electrode is changed, the analog switches ASW1 to ASWn are turned ON in accordance with the control signals PCTL and PCTLB, so as to output the holding potential VCOM to each data signal lines S, thereby fixedly holding each data signal line S to the holding potential VCOM. Further, in Time T4, which is after the potential Vcom of the counter electrode, the control signal generating circuit CTL turns OFF the analog switches ASW1 to ASWn by withdrawing the control signals PCTL and PCTLB, thereby allowing the data signal line driving circuit SD to supply the image signal DAT.

Note that the holding potential VCOM may be changed at the same time or after the Vcom of the counter electrode. In other words, it is necessary that the potential Vcom of the counter electrode be changed while the control signals PCTL and PCTLB are active. However, as shown in FIG. 2, it is preferable that the holding potential VCOM is changed before the potential Vcom of the counter electrode is changed.

Figure 3:
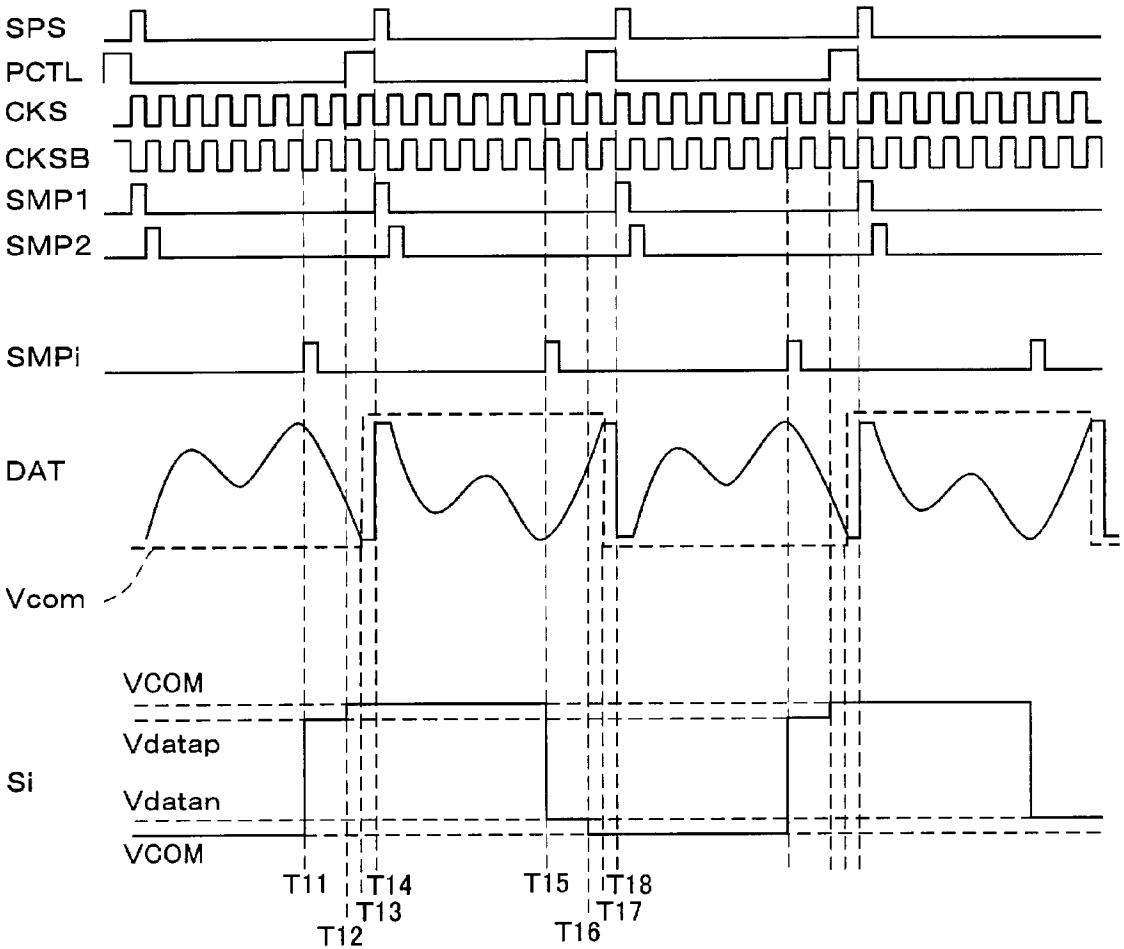
FIG. 3 is a timing chart for explaining in detail an operation shown in FIG. 2.

FIG. 3 is a timing chart for explaining in detail an operation shown in FIG. 2. As described above, FF and NAND gates a1 to an generate sampling signals SMP1 to SMPn sequentially for the respective data signal lines S1, S2, . . . , in respond to the clock signals CKS and CKSB, and data scanning start signal SPS. In accordance with the sampling signals SMP1 to SMPn, the analog switches asw1 to aswn, which deal with both the polarities, sequentially supply to the respective data signal lines S1, S2, . . . , the image signals DAT that realize the opposed AC drive. In FIG. 3, the potential Vcom of the counter electrode that realizes the opposed AC drive, is indicated by a broken line.

As to an i-th data signal line Si, the analog switch aswi is turned ON when the sampling signal SMPi becomes high level at time T11, thereby starting to charging in the data signal line Si a potential Vdatap of the image signal DAT of positive polarity. Substantially in the same timing, a scanning signal line Gj is turned ON, thereby starting charging a pixel capacitor Cp of a pixel in row j, column i with the potential Vdatap of the image signal DAT. When the scanning signal line Gj is turned OFF, the charging of the pixel capacitor Cp is ended. When the sampling signal SMPi becomes low level, the analog switch aswi is turned OFF, thereby floating the data signal line Si, and ending the charging of the data signal line Si.

In time T12, the analog switches ASW1 to ASWn are turned ON in accordance with the control signals PCTL and PCTLB, so as to output the holding potential VCOM to the respective data signal lines S. Next in time T13, the potential Vcom of the counter electrode is changed.

Then in time T14, the analog switches ASW1 to ASWn are turned OFF in accordance with the control signals PCTL and PCTLB, thereby floating the respective data signal lines S, while an input of the data scanning start signal SPS starts a next horizontal scanning period, thereby starting outputting an image signal DAT of negative polarity.

Similarly, in time T15, a potential Vdatan of the image of the image signal DAT of negative polarity is supplied to the data signal line Si. Then, in time T16, the analog switches ASW1 to ASWn are turned ON, so as to output the holding potential VCOM to the respective data signal lines S. Next in time T17, the potential Vcom of the counter electrode is changed. Then in time T18, the analog switches ASW1 to ASWn are turned OFF, thereby floating the respective data signal lines S, while an input of the data scanning start signal SPS starts a next horizontal scanning period, thereby starting outputting an image signal DAT of positive polarity.

Therefore, even when coupling capacitors between the respective data signal lines S and the counter electrode changes the potentials of the data signal lines S, following the change in the potential Vcom of the counter electrode, the potentials of the data signal lines S will not be changed to be undesirably large potentials, because the potentials of the data signal lines S are fixedly held to the holding potential VCOM. Because of this, it is possible to supply to the pixel capacitors Cp a charge corresponding to a gradation to be displayed, by using the potentials of the data signal lines S, which are relatively low. This arrangement lowers the power supply voltage of the data signal line driving circuit SD, thereby reducing the electric power consumption.

For example, in case where, as in the prior art, Vdatap =7V, Vdatan =2V, an amplitude of Vcom =5V, and the power supply of the data signal line driving circuit SD has an offset of 2V from the GND, the potentials of the data signal lines S are 7V or 2V even if the potential Vcom of the counter electrode is changed. For this reason, the power supply voltage of the data signal line driving circuit SD can be as low as 5V, thus, even if a margin of 3V is given, the power supply voltage of the data signal line driving circuit SD can be suppressed to 8V. Where an electric power consumption P of a conventional power supply voltage is a power supply voltage of 12V plus a margin of 3V, according to Equation 1, the arrangement of the present invention gives an electric power consumption P' as follows:

$$P'=(8/15)^2P=(64/225)P \quad (2)$$

thus reducing the electric power consumption by about 70%.

Figure 4:
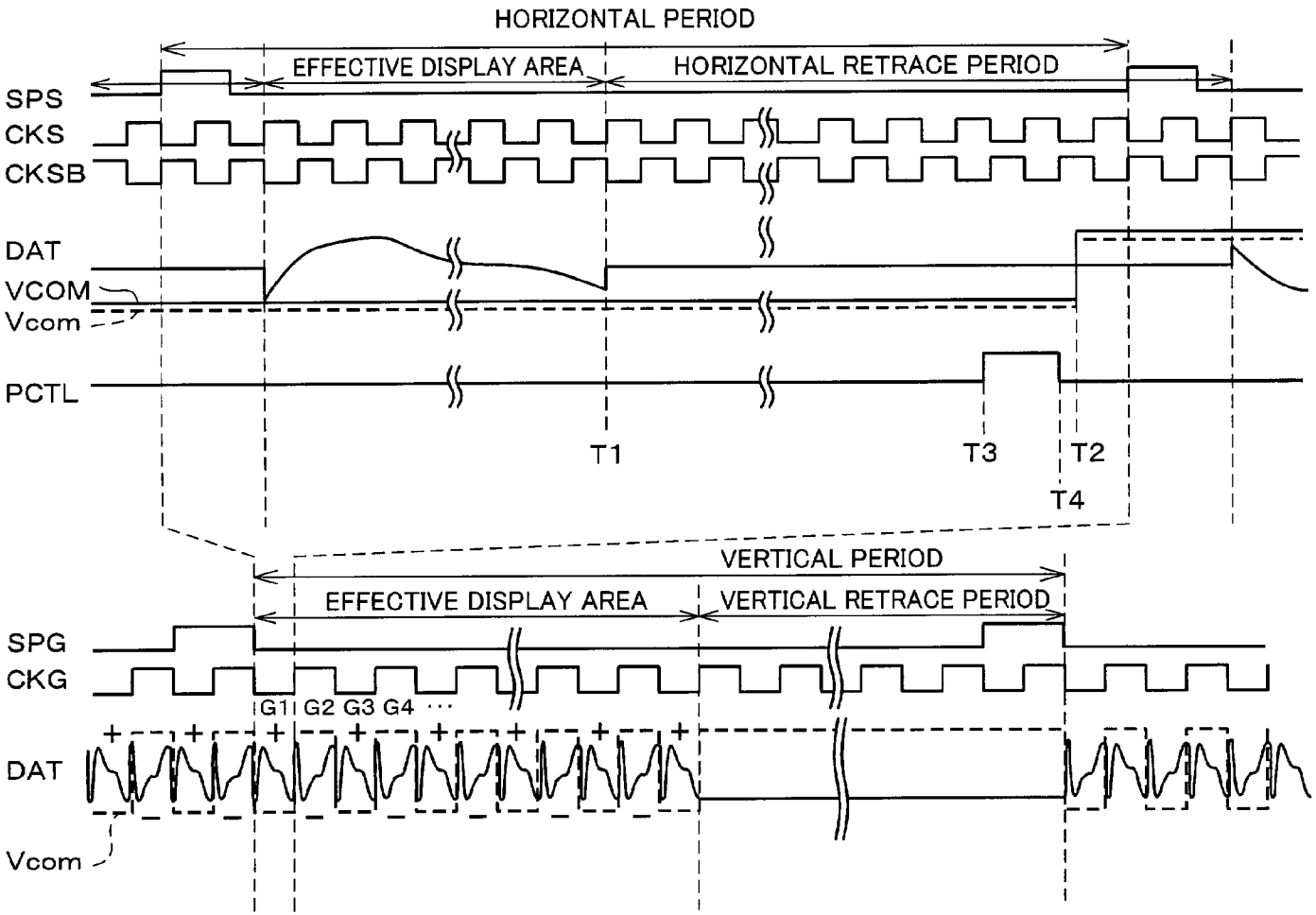
FIG. 4 is a waveform chart showing another example of the drive waveform of the liquid crystal display device.

FIG. 4 is a waveform chart showing another example of the drive waveform of the liquid crystal display device 11. In this example of the drive, as in FIG. 2, a horizontal-line-inversion-type driving method is employed. Thus, sections equivalent to those in FIG. 2 are labeled in the same manner and their explanation is omitted here.

It should be noted that, in time T2 in which the potential Vcom of the counter electrode is changed, the control signals PCTL and PCTLB are not active, that is, the potentials of the data signal lines S are not fixedly held by the holding circuit 10. Instead, in time T3, which is before time T2, the control signals PCTL and PCTLB are active thereby causing the holding potential VCOM, which is to be supplied to the data signal lines S, to be substantially equal to the potential Vcom of the counter electrode at the time.

When the potentials of the data signal lines S are substantially equal to the potential Vcom of the counter electrode, the charges accumulated in the coupling capacitors between the data signal lines S and the counter electrode become substantially zero. Because of this, even if the potential Vcom of the counter electrode is changed in time T2, the potentials of the data signal lines S will not be changed to undesirably large potentials, following the change in the potential Vcom. Thus, it is possible to supply to the pixel capacitor Cp the electric charge corresponding to the gradation to be displayed, by using the potentials of the data signal lines S, which are relatively low. Again with this arrangement, it is possible to lower the power supply voltage of the data signal line driving circuit SD, thereby reducing the electric power consumption.

Figure 5:
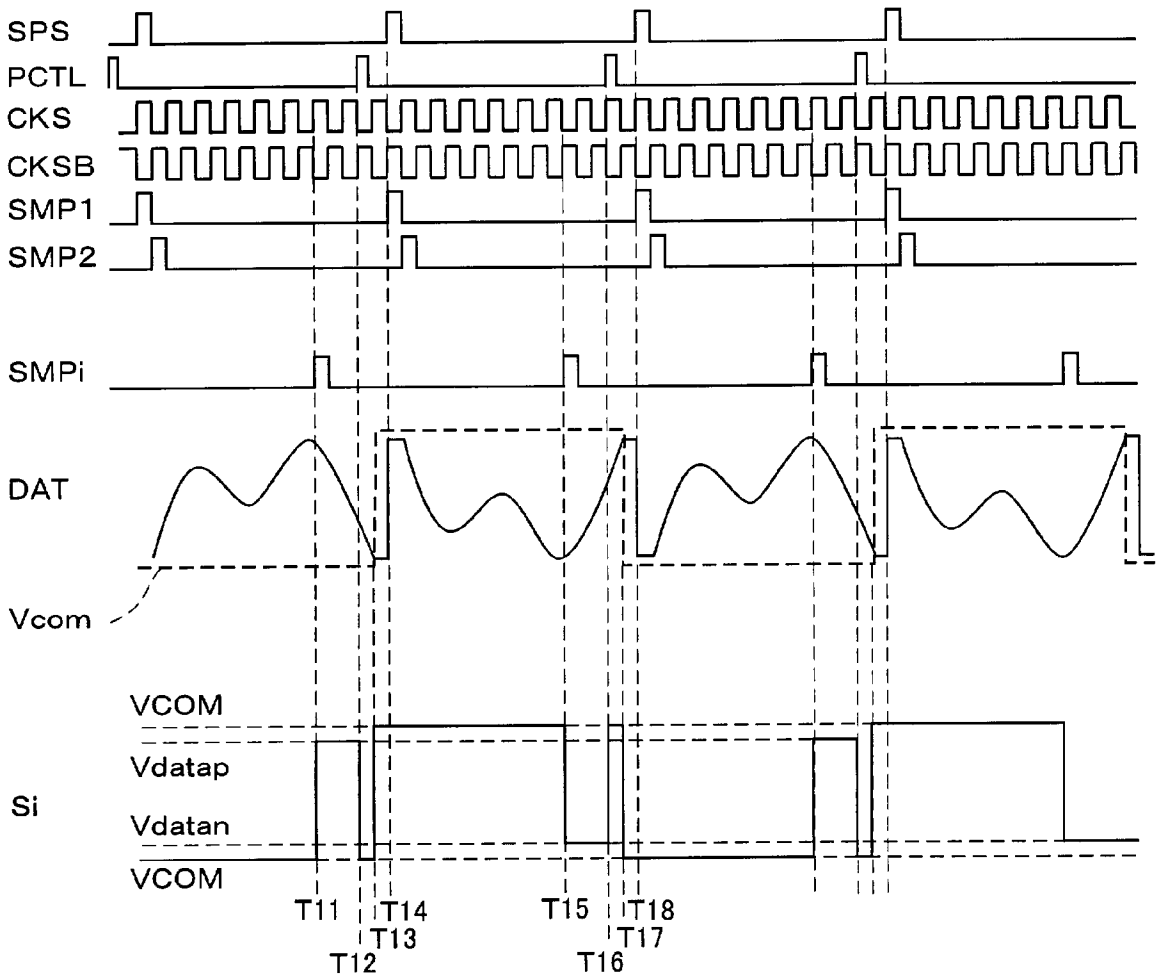
FIG. 5 is a timing chart for explaining in detail an operation shown in FIG. 4.

FIG. 5 is a timing chart for explaining in detail the operation shown in FIG. 4. Sections corresponding to those shown in FIG. 3 are labeled in the same manner and their explanation is omitted here.

In the example of driving shown in FIG. 3, before the control signals PCTL and PCTLB become active in time T12, the holding potential VCOM is changed to the potential Vcom of the counter electrode in the next horizontal scanning period. On the contrary, in an example of driving shown in FIG. 4, the holding potential VCOM, which is supplied to the data signal lines S when the control signals PCTL and PCTLB become active in time T12, is the potential Vcom of the counter electrode that has not been changed. Then, after the respective data signal lines S are floated in accordance with the control signals PCTL and PCTLB, the potential Vcom of the counter electrode is changed in time T13. Then, in time T14, an input of the data scanning start signal SPS starts a next horizontal scanning period, thereby starting outputting an image data DAT of negative polarity.

Similarly, in time T16, outputted to the respective data signal lines S is the potential Vcom of the counter electrode that has not been changed to be the holding potential VCOM. Then, in time T17, the potential Vcom of the counter electrode is changed. Next, in time T18, a next horizontal scanning period is started, thereby starting outputting an image signal DAT of positive polarity.

Therefore, even when the potentials of the data signal lines S are changed in accordance with the coupling capacitor between the respective data signal lines S and the counter electrode, in accordance with the change in the potential Vcom of the counter electrode, the potentials of the data signal lines S will not be changed to undesirably large potentials, because no electrical charge is accumulated in the coupling capacitor. Thus, it is possible to supply to the pixel capacitor Cp the electric charge corresponding to the gradation to be displayed, by using the potentials of the data signal lines S, which are relatively low. With this arrangement, it is possible to lower the power supply voltage of the data signal line driving circuit SD, thereby reducing the electric power consumption.

Moreover, in the liquid crystal display device 11, an active element of the data signal line driving circuit SD, an active element of the scanning signal line driving circuit GD, and the active element SW of the pixel circuit are composed of a polycrystal silicone thin layer transistor, and are formed on a substrate. Compared with a monocrystal silicone, it is easier to enlarge an area of the polycrystal silicone thin layer. Thus, use of polycrystal silicone thin layer allows the substrate to easily have a large area. Therefore, even if the coupling capacitance is increased due to the large areas of the substrate, the method of the present invention controls the potential change in the data signal lines S caused by the change in the potential Vcom of the counter electrode, thus suitably adopting the present invention.

Furthermore, in the liquid crystal display device 11, the data signal line driving circuit SD, the scanning signal line driving circuit GD, and the respective pixel circuits include an active element that is manufactured at a process temperature of 600° C. or less. When the process temperature is set to 600° C. or less, use of a general glass substrate (a glass substrate having a distortion point of 600° C. or less) does not result in a warp or a distortion, which is due to processes having a process temperature higher than the distortion point. This attains a substrate to which components can be easily mounted, and which has a large area. Therefore, even if the coupling capacitance is increased due to the large areas of the substrate, the method of the present invention controls the potential change in the data signal lines S caused by the change in the potential Vcom of the counter electrode, thus suitably adopting the present invention.

Note that the potential to be supplied to the data signal lines S from the potential holding circuit 10 may have any value, provided that the power supply voltage of the data signal line driving circuit SD can be reduced by the potential of that value, even though in the above description, the potential to be supplied to the data signal lines S from the potential holding circuit 10 is equivalent to the potential Vcom of the counter electrode. However, with the arrangement in which the potential to be supplied to the data signal lines S from the potential holding circuit 10 is equivalent to the potential Vcom, it is possible to reduce the potential change in the data signal lines S that is caused by the change in the potential Vcom of the counter electrode, thereby suitably reducing the power supply voltage of the data signal line driving circuit SD.

Moreover, the above description discusses the example in which the horizontal-line-inversion-type driving method is employed. However, the present invention can be adopted in a frame-inversion type driving method. In this case, it may be so arranged that the potentials of the data signal lines S are fixedly held in a vertical retrace period that is between an end of selective scanning of the last scanning signal line Gm and begging of a next frame period, and the data signal lines S are floated again after the potential Vcom of the counter electrode is changed.

Described below is another embodiment of the present invention, with respect to FIG. 6.

Figure 6:
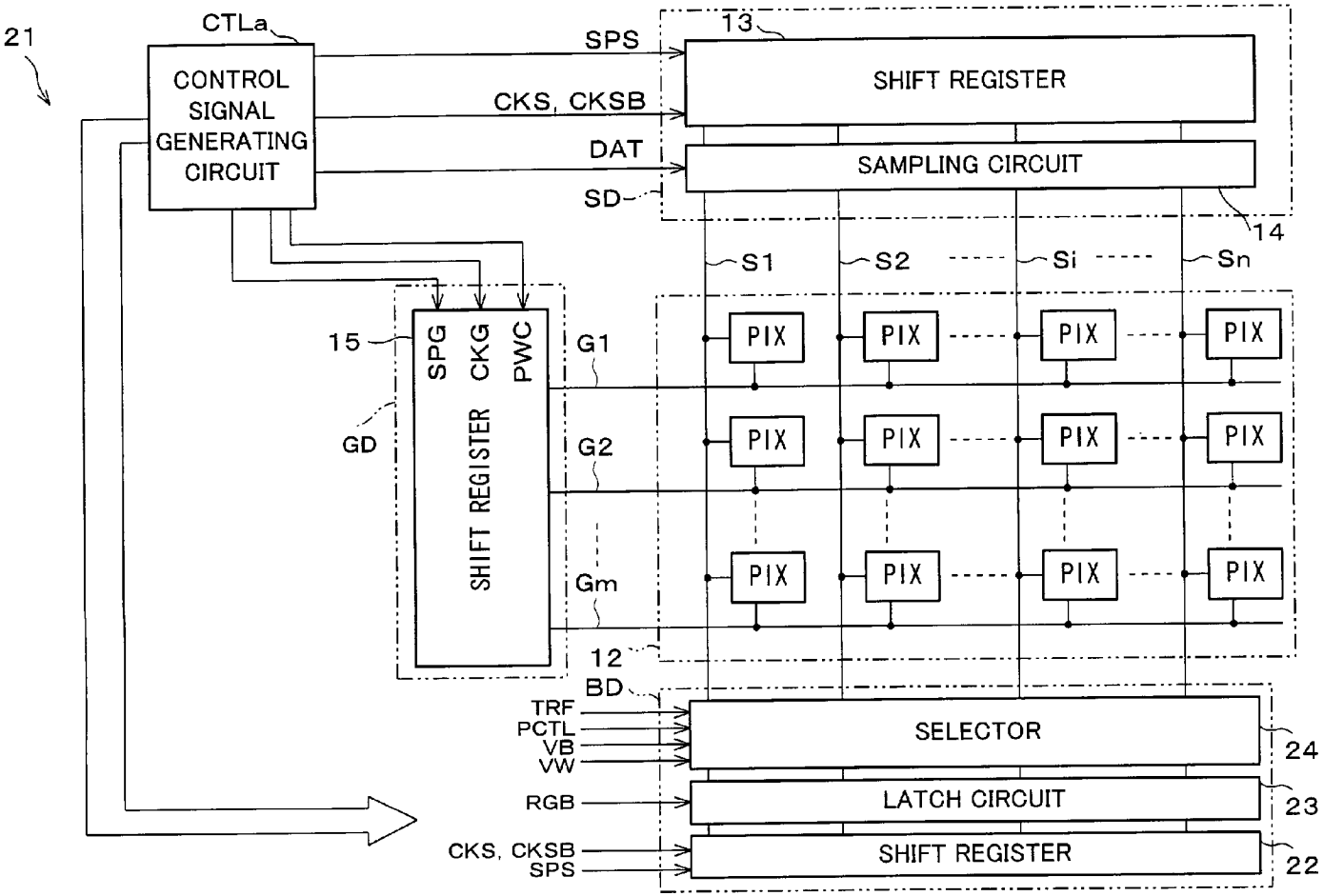
FIG. 6 is a block diagram showing an electric structure of a liquid crystal display device, which is an image display device of another embodiment of the present invention.
Figure 7:
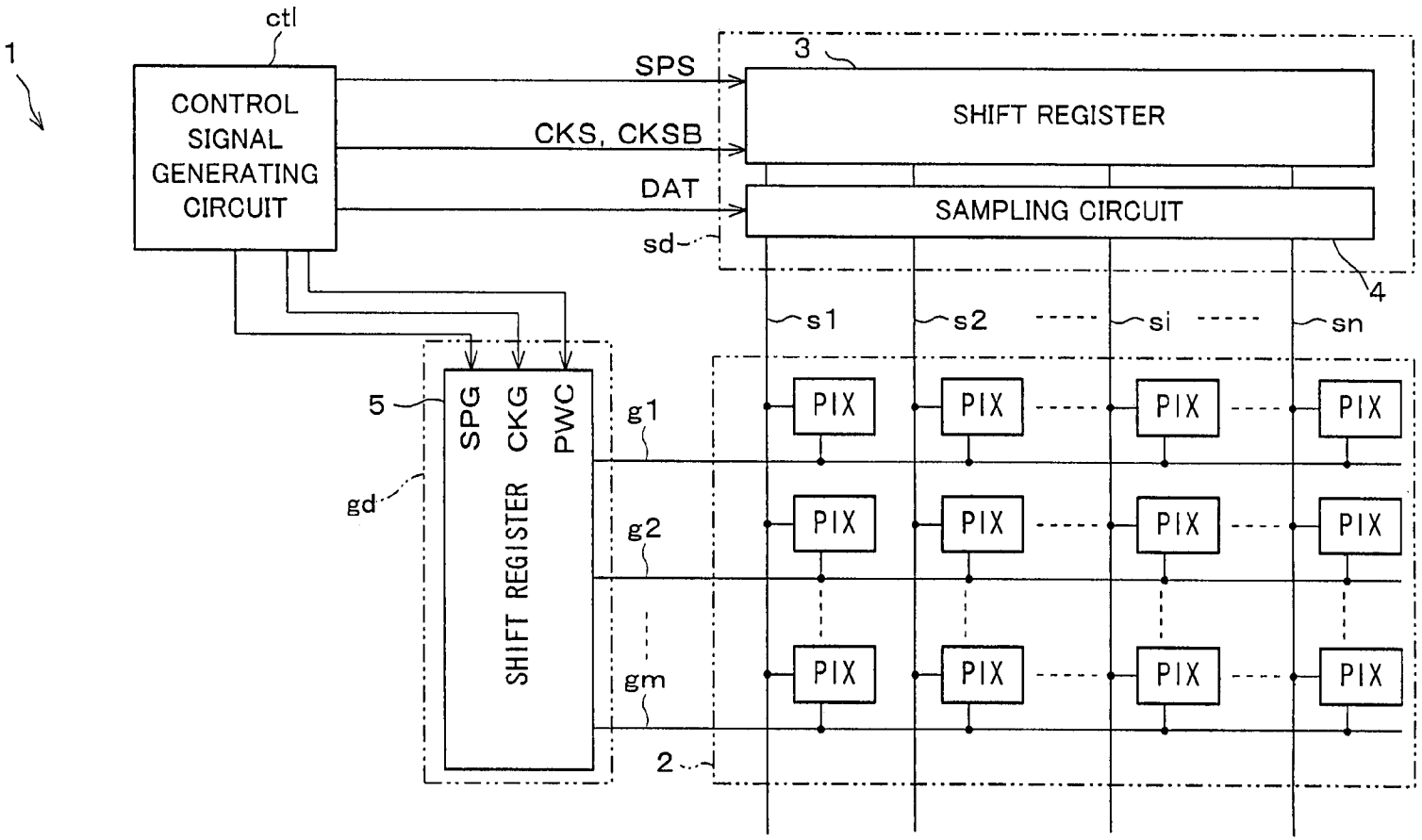
FIG. 7 PRIOR ART
FIG. 7 is a block diagram showing an electric structure of a liquid crystal display device, which is a typical conventional/prior art image display device of active matrix system.

FIG. 6 is a block diagram illustrating an electric structure of a liquid crystal display device 21, which is an image display device of another embodiment of the present invention. The liquid crystal device 21 is similar to the liquid crystal display device 11; in FIG. 6, sections corresponding to those of liquid crystal display device 11 are labeled in the same manner and their explanation is omitted here.

It should be noted that in the liquid crystal display device 21, a binary data signal line driving circuit BD also functions as a potential holding means. Specifically, the data signal line driving circuit SD outputs image signals DAT of multiple gradations to the data signal lines S, while the binary data signal line driving circuit BD outputs image signals RGB of two gradations to the data signal lines S. The liquid crystal display device 21 is used in such a device, which needs high display property at a time of use, and which displays a minimum display in a relatively low display property at a time of standby, such as a display device of a portable telephone.

The binary data signal line driving circuit BD is, schematically, provided with a shift register 22, a latch circuit 23, and a selector 24. The shift register 22 is composed of FFs multiply cascaded (serially connected in multiple stages), similarly to the data signal line driving circuit sd, the shift registers 3 and 13 of the data signal line driving circuit SD. Upon reception of clock signals CKS, and CKSB, and a data scanning start signal SPS from a control signal generating circuit CTLa, the data scanning start signal SPS is outputted from between the respective adjacent FFs so as to be a latch pulse. In response to this, the latch circuit 23 sequentially latches the binary image signals RGB for display, which is inputted from the control signal generating circuit CTLa. The selector 24, in response to a control signal TRLF supplied from the control signal generating circuit CTLa, selects, in accordance with the image signals RGB, one of a liquid crystal applying voltages VB and VW, which are supplied from the control signal generating circuit CTLa. Then, the selector 24 outputs the selected one of the liquid crystal applying voltages VB and VW to the respective data signal lines S. With an arrangement to selectively scan the scanning signal lines G in accordance with this, it is possible to drive in two gradations.

In the binary data signal line driving circuit BD thus arranged, it is possible to realize an operation similar to that of the potential holding circuit 10, by arranging such that the control signal PCTL is supplied to the selector 24 so that one of the liquid crystal applying voltages, for example, VW when the liquid crystal is a normally-white liquid crystal, is outputted to the respective data signal lines S in response to the input of the control signal PCTL. With this arrangement, it is possible to use the binary data signal line driving circuit BD also as a potential holding means for realizing a low electricity consuming operation, without specially having a potential holding means.

In addition, it is possible to realize a similar operation, without using the control signal PCTL, by arranging such that a sequence of the control signal TRF is changed and a reset signal is supplied to the latch circuit 23. Specifically, the arrangement is as follows: when the latch circuit 23 is reset, the one of the liquid crystal applying voltage (VW) is selected, so as to cause all the scanning signal lines G to be in non-selective scanning state; after the selector 24 outputs the liquid crystal applying voltage (VW) in accordance with the control signal TRF, the potential Vcom of the counter electrode is changed, thereby stopping the output of the liquid crystal applying voltage (VW).

Moreover, the means to fixedly hold the potentials of the data signal lines S is only required to have an arrangement in which, when the potential Vcom of the counter electrode are changed, the data signal lines S are not floated without affecting the display. For example, the means may have such an arrangement that a dummy scanning signal line Gm+1 and an active element SW and a pixel capacitor Cp, which are for the dummy scanning signal line Gm+1, are provided next to the last scanning signal line Gm, so that the dummy scanning signal line Gm+1 is selectively scanned while the potential Vcom of the counter electrode is changed.

Incidentally, a pre-charge circuit is similar to the arrangement of the present invention. However, the pre-charge circuit is so arranged that an electric charge accumulated in data signal lines S is removed before image signals DAT are supplied to the data signal lines S from a data signal line driving circuit SD, thereby reducing load and electric consumption of data signal line driving circuit SD for supplying next image signals DAT. In short, the change in the potential Vcom of the counter electrode is not considered in the pre-charge circuit. Thus, the pre-charge circuit is different from the present invention.

Note that in the above description, the change in the potentials of the data signal lines S is discussed. It is needless to say that the pixels for displaying, which are separated from the data signal lines S by the active elements SW, can display without any effect on their displays, functioning as normal as conventional pixels.

The present invention can be suitably applied to an image display device of other active matrix method.

An image display device of the present invention, including, in each area sectored by a plurality of scanning lines and a plurality of data signal lines intersecting with each other, a pixel circuit including an electro-optic element and a corresponding pair of an active element and a pixel electrode, the electro-optic element being driven to create a display in accordance with an electric charge that has been taken in a pixel capacitor by the active element, the pixel capacitor being formed between the pixel electrode and an counter electrode, the image display device is provided with a potential holding section for fixedly holding potentials of the data signal lines before a potential of the counter electrode is changed.

This arrangement is adopted in the image display device in which the active element is provided at each intersection between the plurality of the scanning signal lines and the plurality of the data signal lines intersecting with each other, so that the active element supplies the image signal of the data signal lines into the pixel capacitor by selectively scanning the scanning signal lines, so as to drive the electro-optic element by the thus taken-into electric charge so as to create a display, so as to maintain the display in a non-selective period. With the above arrangement adopted in the image display device, when performing an opposed AC drive, the potentials of the data signal lines in the non-selective period, is fixedly held by the potential holding section, and then the potential of the counter electrode is changed while the potentials of the data signal lines are thus fixedly held. Here, the potential holding section becomes high impedance at a time at which selective scanning of the scanning signal lines is about to be started in a next frame, thereby floating the data signal lines at the time.

Therefore, coupling capacitances between the data signal lines and the counter electrode will not cause the potentials of the data signal lines to be undesirably large potentials, when the potential of the counter electrode is changed for line-inverting drive or frame-inverting drive. With this arrangement, it is possible to supply to the pixel capacitor an electric charge corresponding to a gradation to be displayed, by using relatively low potentials of the data signal lines. This lowers a power supply voltage of a data signal driving circuit, thus reducing the electric power consumption.

Moreover, the image display device of the present invention is so arranged that the potential holding section fixedly hold the potentials of the data signal lines to be equivalent with the potential of the counter electrode.

With the above arrangement, in which the potentials of the data signal lines are fixed held to be equivalent with the potential of the counter electrode before the potential of the counter electrode is changed, it is possible to reduce a potential change in the data signal line of the data signal lines, which is caused by the change in the potential of the counter electrode. This reduces the change in the potentials of the data signal lines, thereby further reducing the power supply voltage of the data signal line driving circuit, and thus reducing the electric power consumption.

Furthermore, an image display device of the present invention, including, in each area sectored by a plurality of scanning lines and a plurality of data signal lines intersecting with each other, a pixel circuit including an electro-optic element and a corresponding pair of an active element and a pixel electrode, the electro-optic element being driven to create a display in accordance with an electric charge that has been taken in a pixel capacitor by the active element, the pixel capacitor being formed between the pixel electrode and an counter electrode, the image display device is provided with a potential holding section for fixedly holding, to be equivalent with a potential of the counter electrode, potentials of the data signal lines when a potential of the counter electrode is changed, and for removing an electric charge between the counter electrode and each data signal line.

This arrangement is adopted in the image display device in which the active element is provided at each intersection between the plurality of the scanning signal lines and the plurality of the data signal lines intersecting with each other, so that the active element supplies the image signal of the data signal lines into the pixel capacitor by selectively scanning the scanning signal lines, so as to drive the electro-optic element by the thus taken-into electric charge so as to create a display, so as to maintain the display in a non-selective period. With the above arrangement adopted in the image display device, when performing an opposed AC drive, the potentials of the data signal lines in the non-selective period, is temporally fixedly held by the potential holding section so as to be equivalent to the potential of the counter electrode, and the electric charge between the counter electrode and each data signal line is removed. Here, the potential holding section becomes high impedance at a time at which selective scanning of the scanning signal lines is about to be started in a next frame, thereby floating the data signal lines at the time.

Here, it may be arranged so that after that the potential of the counter electrode is changed following a change in the potential of the counter electrode, when the potential of the counter electrode is changed, or that the potential holding section becomes high impedance to be floated.

Therefore, coupling capacitances between the data signal lines and the counter electrode will not cause the potentials of the data signal lines to be undesirably large potentials, when the potential of the counter electrode is changed for line-inverting drive or frame-inverting drive. With this arrangement, it is possible to supply to the pixel capacitor an electric charge corresponding to a gradation to be displayed, by using relatively low potentials of the data signal lines. This lowers a power supply voltage of a data signal driving circuit, thus reducing the electric power consumption.

Further, the image display device of the present invention is so arranged that a binary data signal line drive is used as a data signal line driving circuit for outputting an image signal to the data signal lines, and functions as the potential holding section. In short, the image display device of the present invention is so arranged that the potential holding section is a binary data signal line drive, which functions as a data signal line drive for outputting an image signal to the data signal lines, and functions as the potential holding section.

With the above arrangement, the potentials of the data signal lines are fixedly held to a potential of appropriate one of the binary values selected by the data signal line driving circuit. This arrangement can control the potential change of the data signal lines due to the potential change of the counter electrode, whereby this arrangement eliminates a need of another arrangement for controlling the potential change as such.

Furthermore, the image display device of the present invention, including a scanning signal line driving circuit, is so arranged that the pixel circuit, the data signal line driving circuit, and the scanning signal line driving circuit are formed on a substrate, and the active element of the pixel circuit, an active element of the data signal line driving circuit, and an active element of the scanning signal line driving circuit are composed of a polycrystal silicone thin film transistor.

In the above arrangement, the active elements of the data signal line driving circuit, the scanning signal line driving circuit, and the pixel circuit are composed of a polycrystal silicone thin film transistor because use of polycrystal silicone thin layer is easily increases the area of the substrate, compared with the monocrystal silicone. Further, the pixel circuit, the data signal line driving circuit, and the scanning signal line driving circuit are formed on a substrate. With this arrangement, it is possible to attain a substrate having a large area.

Therefore, even if the coupling capacitance is increased due to the large areas of the substrate, the method of the present invention control the potential change in the data signal lines caused by the change in the potential of the counter electrode, thus suitably adopting the present invention.

Moreover, the image display device of the present invention, including a scanning signal line driving circuit, is so arranged that an active element of the data signal line driving circuit, and an active element of the scanning signal line driving circuit are manufactured at a process temperature of 600° C. or less.

With the above arrangement, in which the process temperature is set to 600° C. or less, use of a general glass substrate (a glass substrate having a distortion point of 600° C. or less) does not result in a warp or a distortion, which is due to processes having a process temperature higher than the distortion point. This attains a substrate to which components can be easily mounted, and which has a large area.

Therefore, even if the coupling capacitance is increased due to the large areas of the substrate, the method of the present invention control the potential change in the data signal lines caused by the change in the potential of the counter electrode, thus suitably adopting the present invention.

Furthermore, a display driving method of an image display device of the present invention, including, in each area sectored by a plurality of scanning lines and a plurality of data signal lines intersecting with each other, a pixel circuit including an electro-optic element and a corresponding pair of an active element and a pixel electrode, the electro-optic element being driven to create a display in accordance with an electric charge that has been taken into a pixel capacitor by the active element, the pixel capacitor being formed between the pixel electrode and an counter electrode, the display driving method includes the step of fixedly holding potentials of the data signal lines before a potential of the counter electrode is changed.

The display driving method of the present invention is so arranged that the potentials of the data signal lines are fixedly held to be equivalent with the potential of the counter electrode.

Further, a display driving method of an image display device of the present invention, including, in each area sectored by a plurality of scanning lines and a plurality of data signal lines intersecting with each other, a pixel circuit including an electro-optic element and a corresponding pair of an active element and a pixel electrode, the electro-optic element being driven to create a display in accordance with an electric charge that has been taken in a pixel capacitor by the active element, the pixel capacitor being formed between the pixel electrode and an counter electrode, the display driving method includes the step of fixedly holding, to be equivalent with a potential of the counter electrode, potentials of the data signal lines when a potential of the counter electrode is changed, and for removing an electric charge between the counter electrode and each data signal line.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. An image display device comprising, in each area sectored by a plurality of scanning lines and a plurality of data signal lines intersecting with each other, a pixel circuit including an electro-optic element and a corresponding pair of an active element and a pixel electrode, the electro-optic element being driven to create a display in accordance with an electric charge that has been taken in a pixel capacitor by the active element, the pixel capacitor being formed between the pixel electrode and a counter electrode, the image display device further comprising:

a potential holding section for holding, during a horizontal display period, the data signal lines to a specific potential before a potential of the counter electrode is changed.

2. The image display device as set forth in claim 1, wherein:

the potential holding section fixedly holds the potentials of the data signal lines to be equivalent with the potential of the counter electrode.

3. The image display device as set forth in claim 1, wherein:

the potential holding section is a binary data signal line drive, which functions as a data signal line drive for outputting an image signal to the data signal lines, and functions as the potential holding section.

4. The image display device as set forth in claim 1, including a scanning signal line driving circuit, wherein:

the pixel circuit, the data signal line driving circuit, and the scanning signal line driving circuit are formed on a substrate, and the active element of the pixel circuit, an active element of the data signal line driving circuit, and an active element of the scanning signal line driving circuit are composed of a polycrystal silicone thin film transistor.

5. The image display device as set forth in claim 1, including a scanning signal line driving circuit, wherein:

the active element of the pixel circuit, an active element of the data signal line driving circuit, and an active element of the scanning signal line driving circuit are manufactured at a process temperature of 600° C. or less.

6. An image display device comprising, in each area sectored by a plurality of scanning lines and a plurality of data signal lines intersecting with each other, a pixel circuit including an electro-optic element and a corresponding pair of an active element and a pixel electrode, the electro-optic element being driven to create a display in accordance with an electric charge that has been taken in a pixel capacitor by the active element, the pixel capacitor being formed between the pixel electrode and a counter electrode, the image display device further comprising:

a potential holding section for holding, during a horizontal display period the data signal lines to be equivalent with a potential of the counter electrode when a potential of the counter electrode is changed, and for removing an electric charge between the counter electrode and each data signal line.

7. The image display device as set forth in claim 6, wherein:

the potential holding section is a binary data signal line drive, which functions as a data signal line drive for outputting an image signal to the data signal lines, and functions as the potential holding section.

8. The image display device as set forth in claim 6, including a scanning signal line driving circuit, wherein:

the pixel circuit, the data signal line driving circuit, and the scanning signal line driving circuit are formed on a substrate, and the active element of the pixel circuit, an active element of the data signal line driving circuit, and an active element of the scanning signal line driving circuit are composed of a polycrystal silicone thin film transistor.

9. The image display device as set forth in claim 6, including a scanning signal line driving circuit, wherein:

the active element of the pixel circuit, an active element of the data signal line driving circuit, and an active element of the scanning signal line driving circuit are manufactured at a process temperature of 600° or less.

10. A display driving method of an image display device that includes, in each area sectored by a plurality of scanning lines and a plurality of data signal lines intersecting with each other, a pixel circuit including an electro-optic element and a corresponding pair of an active element and a pixel electrode, the electro-optic element being driven to create a display in accordance with an electric charge that has been taken in a pixel capacitor by the active element, the pixel capacitor being formed between the pixel electrode and a counter electrode, the display driving method comprising the step of:

holding, during a horizontal display period, the data signal lines to a specific potential before a potential of the counter electrode is changed.

11. The display driving method as set forth in claim 10, wherein:

the potentials of the data signal lines are fixedly held to be equivalent with the potential of the counter electrode.

12. A display driving method of an image display device that includes, in each area sectored by a plurality of scanning lines and a plurality of data signal lines intersecting with each other, a pixel circuit including an electro-optic element and a corresponding pair of an active element and a pixel electrode, the electro-optic element being driven to create a display in accordance with an electric charge that has been taken in a pixel capacitor by the active element, the pixel capacitor being formed between the pixel electrode and a counter electrode, the display driving method comprising the step of:

holding, during a horizontal display period, the data signal lines to be equivalent with a potential of the counter electrode when a potential of the counter electrode is changed for the next display period, and for removing an electric charge between the counter electrode and each data signal line.

13. The image display device as set forth in claim 1, wherein:

the potential holding section holds the potentials of the data signal lines to be equivalent with a potential to which the counter electrode will be changed.

14. The display driving method as set forth in claim 10, wherein:

the potentials of the data signal lines are held to be equivalent with a potential to which the counter electrode will be changed.

15. The image display device as set forth in claim 1, wherein the potential holding section is configured and arranged so as to be selectively operably coupled to each of the data signal lines such that the potential holding section is operably coupled to the data signal lines after the electric charge has been taken in the pixel electrode and before the potential of the counter electrode is changed.

16. The image display device of claim 15, wherein the potential holding section is selectively operably coupled to one of (a) a distal end of each data signal line, the distal end being distal from a data scanning line driving circuit or (b) a proximal of each data signal line, the proximal end being proximal to a data scanning line driving circuit.

17. The image display device as set forth in claim 6, wherein the potential holding section is configured and arranged so as to be selectively operably coupled to each of the data signal lines such that the potential holding section is operably coupled to the data signal lines after the electric charge has been taken in the pixel electrode and before the potential of the counter electrode is changed.

18. The image display device of claim 17, wherein the potential holding section is selectively operably coupled to one of (a) a distal end of each data signal line, the distal end being distal from a data scanning line driving circuit or (b) a proximal of each data signal line, the proximal end being proximal to a data scanning line driving circuit.

19. The display driving method as set forth in claim 10, wherein said applying a potential includes selectively operably coupling a potential source to each of the plurality of data signal lines.

20. The display driving method as set forth in claim 12, wherein said applying a potential includes selectively operably coupling a potential source equivalent with a potential of the counter electrode to each of the plurality of data signal lines.

* * * * *